US009416555B2

(12) United States Patent
De Abreu et al.

(10) Patent No.: US 9,416,555 B2
(45) Date of Patent: Aug. 16, 2016

(54) STRUCTURE FOR SUPPORTING ELECTRIC POWER TRANSMISSION LINES

(75) Inventors: Paulo Emmanuel De Abreu, Curitiba (BR); Paulo Emmanuel De Abreu, Jr., Curitiba (BR)

(73) Assignee: SECCIONAL BRASIL SA, Curitiba (BR)

( * ) Notice: Subject to any disclaimer, the term of this patent is extended or adjusted under 35 U.S.C. 154(b) by 1915 days.

(21) Appl. No.: 12/528,524

(22) PCT Filed: Feb. 28, 2007

(86) PCT No.: PCT/IB2007/050639
§ 371 (c)(1),
(2), (4) Date: Aug. 25, 2009

(87) PCT Pub. No.: WO2008/104837
PCT Pub. Date: Sep. 4, 2008

(65) Prior Publication Data
US 2010/0319983 A1 Dec. 23, 2010

(51) Int. Cl.
*E04H 12/20* (2006.01)
*E04H 12/08* (2006.01)

(52) U.S. Cl.
CPC ..... *E04H 12/20* (2013.01)

(58) Field of Classification Search
CPC ..... E04H 12/20
USPC ..... 174/45 TD, 45 R
See application file for complete search history.

(56) References Cited

U.S. PATENT DOCUMENTS

| | | | |
|---|---|---|---|
| 466,012 | A | 12/1891 | Seaman |
| 1,034,760 | A | 8/1912 | Brackerbohm |
| 1,179,533 | A | 4/1916 | Lachman |

(Continued)

FOREIGN PATENT DOCUMENTS

| | | |
|---|---|---|
| BR | 9606177 | 3/1998 |
| BR | 0501862 | 1/2007 |

(Continued)

OTHER PUBLICATIONS

Manufacturing Wind Turbine Towers, Danish Wind Industry Association Website at http://guidedtour.windpower.org/en/tour/manu/towerm.htm, Sep. 19, 2003.

*Primary Examiner* — William H Mayo, III
*Assistant Examiner* — Hiram E Gonzalez
(74) *Attorney, Agent, or Firm* — Lando & Anastasi, LLP

(57) ABSTRACT

A structure for supporting electric power transmission lines that aims to obtain a better stress and strain behaviour providing a higher ultimate economy. The preferred embodiment is directed to a structure that comprises a metallic vertical structure (101) having: a lower tubular frustum shape (103) with a smaller end (104) and a larger end (105), wherein the smaller end is on the bottom and the larger end on the top; an upper frustum shape (106) with a smaller end (107) and a larger end (108), wherein the smaller end is on the top and the larger end on the bottom; and wherein the larger end of the lower frustum is adjoined to the larger end of the upper frustum; line supporting members (109); side supporting elements (110) attached in the adjoining region (111) of the lower and upper frustums, and extending between the attachment and an anchoring base (113); and wherein the adjoining region is below the line supporting members.

9 Claims, 2 Drawing Sheets

(56) References Cited

U.S. PATENT DOCUMENTS

| | | | | |
|---|---|---|---|---|
| 1,200,453 | A | 10/1916 | Bates | |
| 1,616,931 | A | 2/1927 | Thomas | |
| 2,064,121 | A | 12/1936 | Jenner | |
| 2,116,368 | A | 5/1938 | Staubitz | |
| 2,401,799 | A | 6/1946 | Riemenschneider et al. | |
| 2,410,246 | A | 10/1946 | Scrivener et al. | |
| 2,870,793 | A * | 1/1959 | Bailey | 174/45 R |
| 3,187,175 | A * | 6/1965 | Lang | H02B 1/50 174/150 |
| 3,196,990 | A | 7/1965 | Handley | |
| 3,343,315 | A | 9/1967 | Marsh | |
| 3,504,464 | A | 4/1970 | Bair et al. | |
| 3,571,991 | A | 3/1971 | Doocy et al. | |
| 3,713,262 | A * | 1/1973 | Jatcko | E01F 9/0182 248/158 |
| 3,865,498 | A | 2/1975 | Okuto et al. | |
| 3,935,689 | A | 2/1976 | Bladholm et al. | |
| 4,314,434 | A | 2/1982 | Meisberger | |
| 4,409,429 | A * | 10/1983 | Gaylard | 174/43 |
| 4,431,375 | A | 2/1984 | Carter, Jr. et al. | |
| 5,081,804 | A * | 1/1992 | Andersson | E02D 27/42 405/236 |
| 5,319,901 | A | 6/1994 | Goldsworthy et al. | |
| 5,687,537 | A | 11/1997 | Noble | |
| 5,880,404 | A | 3/1999 | Stanley et al. | |
| 6,286,281 | B1 | 9/2001 | Johnson | |
| 6,343,445 | B1 | 2/2002 | Ryan | |
| 6,408,590 | B1 * | 6/2002 | Cote | E04C 3/30 248/545 |
| 6,668,498 | B2 | 12/2003 | Ritz | |
| 7,059,095 | B1 | 6/2006 | Stevens et al. | |
| 7,098,552 | B2 | 8/2006 | McCoin | |
| 2004/0211149 | A1 | 10/2004 | Rioux | |

FOREIGN PATENT DOCUMENTS

| | | | |
|---|---|---|---|
| CH | 478322 | | 9/1969 |
| DE | 2838239 | A1 | 3/1980 |
| DE | 3640479 | A1 | 6/1988 |
| FR | 592085 | | 7/1925 |
| FR | 622027 | | 5/1927 |
| FR | 648313 | | 12/1928 |
| FR | 927829 | | 11/1947 |
| FR | 1116601 | | 5/1956 |
| FR | 1224955 | | 6/1960 |
| FR | 1525288 | | 5/1968 |
| GB | 668408 | | 3/1952 |
| GB | 955834 | | 4/1964 |
| JP | 09317242 | A | 12/1997 |
| JP | 10046872 | A | 2/1998 |
| JP | 2001355352 | A | 12/2001 |
| JP | 2003027768 | A | 1/2003 |
| JP | 2003120072 | A | 4/2003 |
| JP | 2004143920 | A | 5/2004 |
| JP | 2004245042 | A | 9/2004 |
| JP | 2006219898 | A | 8/2006 |
| NL | 1017638 | | 9/2002 |
| RU | 2083785 | C1 | 7/1997 |
| RU | 2136830 | C1 | 9/1999 |
| RU | 2204671 | C2 | 5/2003 |
| RU | 2248434 | C1 | 3/2005 |
| RU | 20052256758 | C1 | 7/2005 |
| WO | 9721258 | A1 | 6/1997 |
| WO | 0136766 | A1 | 5/2001 |
| WO | 0183984 | A1 | 11/2001 |
| WO | 02103139 | A1 | 12/2002 |
| WO | 03004802 | A1 | 1/2003 |
| WO | 03010402 | A1 | 2/2003 |
| WO | 03010403 | A1 | 2/2003 |
| WO | 2006116863 | A1 | 11/2006 |

* cited by examiner

STRUCTURE FOR SUPPORTING ELECTRIC POWER TRANSMISSION LINES

TECHNICAL FIELD

This invention relates to vertical structures, such as towers, masts, poles or the like, particularly for use for supporting transmission lines of an electric power transmission system.

BACKGROUND ART

Towers, masts, poles or the like (hereinafter simply called 'vertical structure(s)') are well know in the prior art. Each single structure, due to the complexity of the loads being applied and due to other factors, is generally custom designed to the customer's specific requirements (e.g. the owner of the structure, such as an electric power distribution company). In the case of structures for supporting transmission lines of an electric power transmission system, in addition to the vertical structure itself, they also comprise braces, arms or similar members to which the overhead conductors are connected; as well as other accessories and components suitable for the desired purposes. A general overview of the related art may be found, for instance, in the book written by COOMBS, R. D., Pole and tower lines for electric power transmission, Merchant Books, 2006 (1st ed. 1916). General guidelines about the subject matter may be found, for instance, in MAGEE, William L., Design of steel transmission pole structures, ASCE/SEI 48-05, ASCE, 2006 and in American Society of Civil Engineers, Subcommittee on Guyed Transmission Structures, Design of guyed electrical transmission structures, ASCE, 1997, as well as in other standards worldwide. GUNGER, Y. R. et al published the article Novel design of transmission towels from bent metallic sections of non-traditional shapes, Power Technology and Engineering, March, 2003, vol. 37, no. 2, p. 120-122 and articles available at the internet site www.elsi.ru of the 'ÉLSI' Research Production Association, titled 'Use of new constructions of supports [ . . . ]' (GUNGER, Y. R. et ZEVIN A. A.) and 'New constructions of supports from [ . . . ] 220 kV' (GUNGER, Y. R.). Additional exemplary embodiments for supporting transmission lines and or other loads, which in some cases are not designed and capable for supporting particularly transmission lines, may be found also in BR PI9606177; BR PI0501862; CH478322; DE2838239A1; DE3640479A1; FR592085; FR622027; FR648313; FR927829; FR1116601; FR1224955; FR1525288; GB668408; JP10-046872A2; JP 09-317242A2; JP2001-355352A2; JP2003-027768A2; JP2003-120072A2; JP2004-143920A2; JP2004-245042A2; JP2006-219898A2; NL1017638C; RU2083785C1; RU2136830C1; RU2204671C2; RU2204672C2 (WO03004802A1); RU2197587C1(WO03010402A1); RU2197586C1(WO03010403A1); RU2248434C1; RU2256758C; U.S. Pat. No. 466,012; U.S. Pat. No. 1,179,533; U.S. Pat. No. 1,034,760; U.S. Pat. No. 1,200,453; U.S. Pat. No. 1,616,931; U.S. Pat. No. 2,064,121; U.S. Pat. No. 2,116,368; U.S. Pat. No. 2,401,799; U.S. Pat. No. 2,410,246; U.S. Pat. No. 3,196,990; U.S. Pat. No. 3,343,315; U.S. Pat. No. 3,504,464; U.S. Pat. No. 3,571,991; U.S. Pat. No. 3,865,498; U.S. Pat. No. 3,935,689; U.S. Pat. No. 4,314,434; U.S. Pat. No. 531,901; U.S. Pat. No. 5,687,537; U.S. Pat. No. 5,880,404; U.S. Pat. No. 6,286,281; U.S. Pat. No. 6,343,445; U.S. Pat. No. 6,668,498; US20040211149A1; U.S. Pat. No. 7,059,095; U.S. Pat. No. 7,098,552; WO97/21258A1; WO01/36766A1; WO01/83984A1; WO02/103139A1; WO2006/116863A1.

It is common for the customer to make available a 'load tree diagram' for each vertical structure loading variation or, more commonly, for a set of vertical structures loading variations. Nevertheless, there are some different types or configurations of structures that can be grouped into families because of their similar general shape, for instance monopoles, lattice towers, delta towers, etc. The expressions 'monopole(s)', 'pole(s)', 'mast(s)' or 'single column towers' are can be used as synonymous. Many factors are analyzed when determining the advantages and disadvantages of each type of vertical structure family, for instance: manufacturing costs; loads; maintenance considerations; construction ease and infrastructure required for construction; allowable spans and number of structures within a given length; area beneath conductors; structure footprint and need for foundations; impact on right-of-way, vegetation, environment; radio interference, audible noise, and electro-magnetic field; etc.

The load trees diagrams conventionally use an orthogonal coordinate system for specifying the loads, which are classified as: transverse, longitudinal, or vertical loads. For instance, in the case of a structure for an electrical power transmission line, the loads involved are: (i) vertical loads, such as weight of conductors, down-pull caused by level differences between the structures and ice loads; (ii) transverse loads, such as those caused by wind and horizontal pull from deviation angle in the line; (iii) longitudinal loads, such as those caused by pretension of conductor on one side only and by an abnormal load in case of, for instance, a broken wire. Other loads and effects are also considered when designing the structure, such as torsional shear, loads related to the weight of the vertical structure, aeolian vibration, stresses, etc.

In the case of lower tensions, generally up to approximately 64 kV, it is very common to use concrete, wood or steel monopoles. For higher tensions, during the 1950s through the 1970s, self-supporting steel lattice towers, with a general trunkpyramidal shape, H-frame poles, delta towers and the like, were the most common vertical structures built in most countries for electric power transmission lines because at that time they were considered relatively strong, light and could be erected without the need for heavy equipment and major access roads. Nevertheless, this kind of structures takes too much time to design and build; as well as their base foundation requires a large footprint area. Nowadays, steel monopoles are being widely adopted. Such monopoles are usually hollow multi-sided tubes connected together, having a general tapered shape from its bottom to its top. The increased use is because they are considered more aesthetically acceptable, require a smaller footprint and, consequently, have less impact on the right-of-way, and they are easy to transport and assemble in the field.

New designs for structures have been proposed recently. In 'FIG. 1' of the article mentioned supra 'New constructions of supports from [ . . . ] 220 kV', GUNGER shows three kinds of structures which are in use: two self-supporting latticed towers that also require large bases and one guyed tower with a smaller base, in which the guys are attached to the arm members and apparently in the tower, below the larger diameter of the tower which is close to the top of the tower. Different shapes with narrow bases are proposed by GUNGER as alternatives to these three structures.

DISCLOSURE OF INVENTION

Technical—Problem

Although metallic monopoles have some advantages, there are still considerable constraints to a wider use of this kind of structure. In order to support the vertical loads due to the weight of the structure and the bending moments, which are assumed to be higher in the lower sections than in the upper sections, monopoles generally require larger and/or stronger sections in the base region, and hence, heavy and deep foundations.

The alternative structures proposed by GUNGER in the articles mentioned supra, as they do not use tubes, have generally the disadvantage of having low torsional resistance. Furthermore, the prior art structure mentioned by GUNGER in the article "New constructions of supports from [ . . . ] 220 kV', in FIG. 1, which shows guys attached below the largest diameter of the vertical structure, also have some disadvantages, such as: increase of torsional and bending moment in operational conditions due to the longer arms whereto the guys are attached; and the problem of a broken transmission wire that creates serious risk of collapsing of the structure due to the increase of torsional and bending moments.

Conversely, the design proposed by FREYSSINET in FIG. 31 of Patent FR927829 attaches the guys to the region of largest diameter of the vertical structure; however, the vertical structure is made of reinforced pre-stressed concrete, which presents a different stress and strain behaviour compared to metallic structures. In addition, the use of concrete has a number of additional disadvantages.

The support structure for wind turbines proposed by SAMYN in international application published under no. WO01/83984A1 also proposes the attachment of guys to the region of largest diameter of the vertical structure. Nevertheless, the design of vertical structures for wind turbines is subjected to a different set of governing loads, which includes, for instance, the tower stiffness and first-mode natural frequency. As explained by BURTON, et al, Wind energy handbook, p. 374, a key consideration in wind turbine design is the avoidance of resonant tower oscillations excited by rotor thrust fluctuations at rotational or blade-passing frequency. The structural dynamic considerations may impact significantly in the design of the structure. As explained in the website of the Danish Wind Industry Association, www-.windpower.org, the rotor blades on turbines with relatively short towers are subjected to very different wind speeds, and thus different bending when a rotor blade is in its top and in its bottom position, which will increase the fatigue loads. In an example given by the Danish Association, a 50-meter tall wind turbine tower will have a tendency to swing back and forth, say, every three seconds. The frequency with which the tower oscillates back and forth is also known as the eigenfrequency of the tower. The eigenfrequency depends on the height of the tower, the thickness of its walls, the type of steel, and the weight of the nacelle and rotor. Each time a rotor blade passes the wind shade of the tower, the rotor will push slightly less against the tower. If the rotor turns with a rotational speed such that a rotor blade passes the tower each time the tower is in one of its extreme positions, then the rotor blade may either dampen or amplify (reinforce) the oscillations of the tower. Therefore, the governing design criterion of a wind turbine support structure is quite different than in the case of vertical structures for transmission line.

As mentioned by COOMBS, Pole and tower lines [ . . . ], p. 1, the decision on the exact character of supports that will provide the highest ultimate economy, as well as excellence of service, is almost impossible. Nevertheless, it is still very desirable to obtain a vertical structure that overcomes the aforementioned technical difficulties, resulting in a vertical structure with optimal characteristics in regard to weight, strength, price, easiness in manufacturing, transporting and installing, and good aesthetic appearance.

Technical—Solution

To solve the related technical problems and other disadvantages not mentioned herein, certain embodiments of the present invention are directed to a structure for supporting electric power transmission lines characterized by comprising (a) a metallic vertical structure having: (i) a lower tubular frustum shape with a smaller end and a larger end, wherein the smaller end is on the bottom and the larger end on the top; (ii) an upper tubular frustum shape with a smaller end and a larger end, wherein the smaller end is on the top and the larger end on the bottom; and (iii) wherein the larger end of the lower tubular frustum is adjoined to the larger end of the upper frustum; (b) at least one line supporting member; (c) at least one side supporting element, (i) wherein the side supporting element is attached in the adjoining region of the lower and upper frustums, and (ii) said side supporting element extends between the attachment and an anchoring base; and (d) wherein the adjoining region is below the line supporting member or members.

In one exemplary embodiment of the present invention, the adjoining region is the region where the bending moment of the structure is the highest.

In yet another embodiment of the present invention, the side supporting element is a guy, a wire, a cable, a strut, a support brace or a combination thereof.

In another exemplary embodiment, the lower frustum shape comprises at least one tubular frustum section; and the upper frustum shape comprises at least one tubular frustum section.

In another exemplary embodiment the connection between the sections are provided by bolted flanges, slip joint, bolted slip joint, welding or combinations thereof.

In yet another embodiment, the tubular sections have an essentially circular cross section.

In another version, the tubular sections have an essentially elliptical or oblong cross section, wherein preferentially the elliptical or oblong cross section semimajor axis is substantially perpendicular to the orientation of the transmission line. Alternatively, in such embodiment the metallic vertical structure is inclined towards a secondary metallic vertical structure, said vertical structures combinations resulting in a delta structure configuration.

ADVANTAGEOUS EFFECTS

The present invention has several advantages over the prior art. The use of a metallic vertical structure with general opposite frustum shapes with side supporting elements bellow the line supporting members allows the obtaining of a better stress and strain behaviour. This better behaviour is obtained due to the increased mechanical strength in view of the connection between the larger ends of the opposite frustums operating in conjunction with the side supporting elements, in order to resist against buckling due to the transversal loads of the transmission lines. Consequently, it is possible to obtain lighter structures, at lower costs, and which are easier to install and to transport.

In addition, the use of metallic shells according the present invention allows that the maximum bending stress be taken as about 1.4 times the values of the average failure stress, as described by DONNEL, L. H, *A new theory for the buckling*

*of thin cylinders under axial compression and bending*, Trans. Amer. Soc. Mech. Engr. 56, p. 795-806, 1934.

MODE FOR INVENTION

Figure 1:
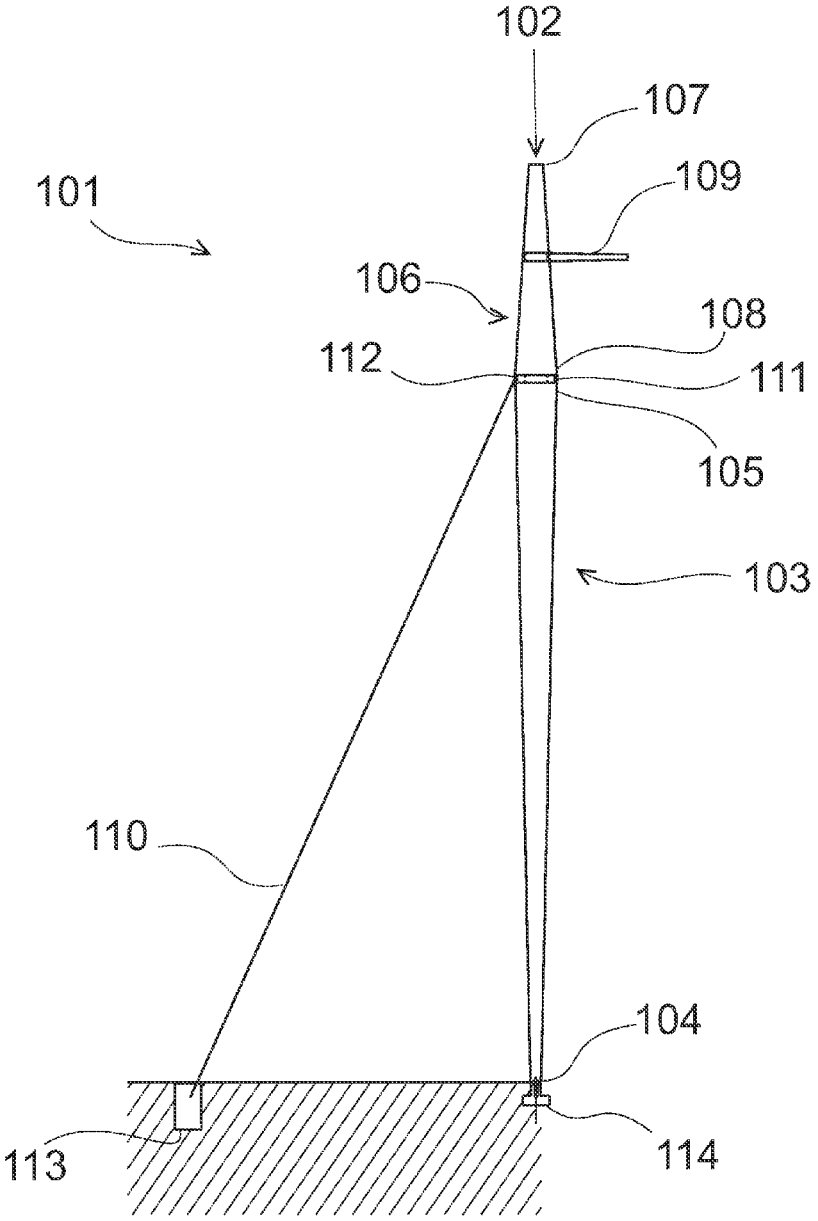
FIG. 1 is a front view of one embodiment of the present invention.

This invention is not limited in its application to the details of construction and the arrangement of components set forth in the following description or illustrated in the drawings. The invention is capable of other embodiments and of being practiced or of being carried out in various ways. Also, the phraseology and terminology used herein is for the purpose of description and should not be regarded as limiting. The use of 'including', 'comprising', or 'having', 'containing', 'involving', and variations thereof herein, is meant to encompass the items listed thereafter and equivalents thereof as well as additional items.

FIG. 1 illustrates one exemplary embodiment of the present invention, more particularly a structure (101) for supporting electric power transmission lines characterized by comprising a metallic vertical structure (102) having: a lower tubular frustum (103) shape with a smaller end (104) and a larger end (105), wherein the smaller (104) end is on the bottom and the larger end (105) on the top; an upper tubular frustum (106) shape with a smaller end (107) and a larger end (108), wherein the smaller end (107) is on the top and the larger end (108) on the bottom; and wherein the larger end (105) of the lower tubular frustum (103) is adjoined to the larger end (108) of the upper tubular frustum (106); a line supporting member (109); a side supporting element (110), wherein the side supporting element (110) is attached in the adjoining region (111) of the lower (103) and upper (106) frustums, extending between the attachment (112) and an anchoring base (113); and wherein the adjoining region (111) is below the line supporting member (109).

The metallic vertical structure (102) may be made of any suitable solid metallic material, such as steel, aluminium or the like, depending upon the specific load tree diagram and desired loadings supporting capacity. As it will be explained further in this specification, the best results for a conventional load and respective design described herein were obtained using a high-strength low-alloy structural steel.

The general shape of the metallic vertical structure (102) itself is of two essentially vertical opposed tubular frustums, a lower (103) and an upper (106). The expression 'tubular frustum' generically means a hollow object, with a constant or variable thickness, resultant from a truncated cone or pyramid in which the plane cutting off the apex is parallel to the base. Notwithstanding the conventional definition of a frustum and although due to manufacturing reasons it is usually easier to produce tubular tubes with parallel ends, for the purposes of this invention, the ends of the frustums, i.e. the base and the intersecting plane, may not be substantially parallel. The tubes may be obtained from rolled or folded metal sheets, resulting in round or multisided cross sections. Regular polygonal cross sections are usually easier to manufacture. The lower tubular frustum (103) generally tapers from its larger end (105), on the top, in the direction of the ground, down to the smaller end (104) in the ground or near the ground. The larger end (105) is the base of a conventional frustum, i.e., the plane with a larger diameter, which for the lower frustum (103) is on the top. The connection between the lower frustum (103) smaller end (104) and the ground or foundation may be made by any suitable means, such as a direct-embedded, anchor bolts, embedded casings, pivot connections or the like. It is important to point out that in some cases it may be desirable to provide reinforcing means to the vertical structure near the ground or foundation, for instance using a flange, a collar ring, a steel caisson, or similar members, which result in a not exactly frustum shape near the ground. Such minor variations are meant to be included within the embodiments of the invention. The upper tubular frustum (106) generally tapers upwardly from its larger end (108) on the bottom in direction to the top, up to the smaller end (107). The upper tubular frustum (106) larger end (108) is adjoined to the larger end (105) of the lower tubular frustum (103). As used in this specification, the word 'adjoined' means being conjugated, connected, attached, consolidated, incorporated, jointed, linked, united, welded, moulded, folded or the like. In this manner, the lower (103) and upper (106) shapes may be obtained by a section that is folded from a point in its length up to its ends; or alternatively, by at least one tubular frustum section in the lower frustum (103) shape and least one tubular frustum section in the upper frustum (106) shape. In most cases, due to the machinery used in such applications it is easier to obtain the opposite frustum shape by producing al least two separate sections which are then connected together, directly or through an intermediary connection such as a flange, forming an adjoining region (111).

In the embodiment shown in FIG. 1, the upper frustum (106) has one line supporting member (109), more specifically, an arm. Such line supporting member (109) may be of any kind and number appropriate to the desired purposes, such as a davit arms, cross-arms, brace or the like. The line supporting member (109) or members project outwardly of the upper frustum (106), and the conductors (not illustrated) are hung on the outer ends of the line supporting member (109) or members through insulators (not illustrated).

As the adjoining region (111) between the larger ends (105) (108) of the lower (103) and upper (106) frustums have larger diameters, this region has an increased mechanical strength. As the bending moment of a structure (101) for transmission lines is in most cases higher below the line support members (109), such adjoining region (111) is below the line supporting members (109), and is supported through a side supporting element (110), more specifically a guy as shown in FIG. 1, that is attached in the adjoining region (111) and extends between the attachment (112) and an anchoring base (113). The side supporting element (110) may be alternatively, a wire, a cable, a strut, a support brace or a combination thereof. Although only one side supporting element (110) is shown in FIG. 1, the number, direction and levels of side supporting elements (110) may vary according to specific loading considerations. The connection between the side supporting elements (110) and the anchoring base (113) may be of any appropriate kind. Deadmen anchors, screw anchors, manta-ray anchors and grouted anchors, are typical types of guy anchors that are commonly used today. Guy fittings and tensioning devices may also be used. The selection of the appropriate configuration for each case is within the scope of a person skilled in the art.

The specific position of the adjoining region (111) will be in most cases below and very close to the line supporting member (109). The best position for the adjoining region (111) is the region where the bending moment of the structure (101) is the highest; however, as it is not practical to calculate for each single structure the exact position, in most cases the adjoining region (111) will be in the region where the bending moment of the structure is substantially higher, i.e., below the line supporting member (109), and generally above the middle point of the lower frustum (103).

As mentioned in this description, the lower frustum (103) shape comprises at least one tubular frustum section and the upper frustum (106) shape comprises at least one tubular frustum section. The connection between the sections may be provided by bolted flanges, slip joint, bolted slip joint, welding or combinations thereof. The tubular sections may have an essentially circular cross section, or an essentially elliptical or oblong cross section. In the case of an elliptical or oblong cross section, the best results are obtained when the semimajor axis is substantially perpendicular to the orientation of the transmission line. In such a case, the metallic vertical structure may be inclined towards a secondary metallic vertical structure, said vertical structures combinations resulting in a delta structure configuration.

Figure 2:
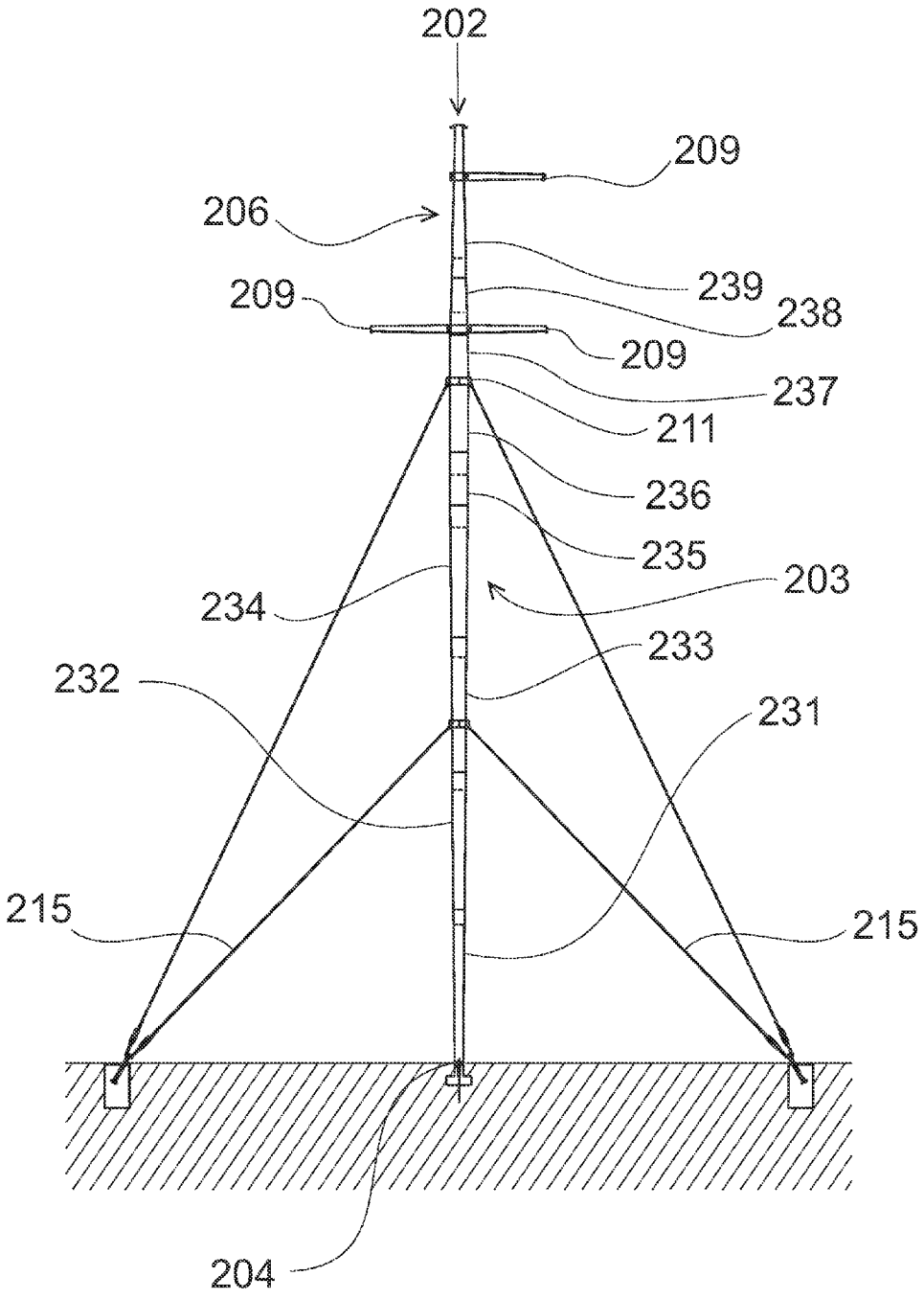
FIG. 2 is a front view of another embodiment of the present invention.

FIG. 2 shows a front view of another exemplary embodiment of the present invention. Such embodiment, as an example, adopts an illustrative case of an emergency restoration system with a loading tree for each one of the three braces (209) according to Table I. FIG. 3 shows a top view of such embodiment.

TABLE I

| | Maximum Transversal Load (N) | Maximum Vertical Load (N) | Maximum Longitudinal Load (N) |
|---|---|---|---|
| Transversal Load | 17200 | 3600 | 3600 |
| Longitudinal Load | — | — | 3950 |
| Vertical Load | 12800 | 18600 | 12800 |

The projected loadings were two Grosbeak CAA 636 wires, with 450 m weight spans with a 1.5 coefficient; 450 m wind span, and 31.94 m/s maximum wind speed. The aims are at about 29 m and 35 m and total height at about 37 m. The metallic vertical structure (102) is made of a high-strength low-alloy structural steel, yield strength superior to 370 MPa, such as a COS-AR-COR 500 (Cosipa) which is an equivalent to ASTM-A588 steel, and 0.00265 m thickness In the exemplary embodiment of FIG. 2 the lower frustum (203) shape comprises six tubular frustum sections (231), (232), (233), (234), (235), (236) that are sequentially connected together by slip joint connections; and the upper frustum (206) shape comprises three tubular frustum sections (237), (238), (239) that are sequentially connected together by slip joint connections. The connection between the adjacent lower (203) and upper (206) frustums shapes is made by a flange. Tables II and III show the exemplary designed dimensions that attend the load tree of Table I.

TABLE II

| Section | Diameter on the top (m) | Diameter on the base (m) | Length of the section (m) | Weight of the section (kg) |
|---|---|---|---|---|
| 231 | 0.350 | 0.445 | 6 | 164.12 |
| 232 | 0.430 | 0.525 | 6 | 197.37 |
| 233 | 0.508 | 0.603 | 6 | 229.79 |
| 234 | 0.584 | 0.680 | 6 | 261.59 |
| 235 | 0.659 | 0.707 | 3 | 141.39 |
| 236 | 0.686 | 0.747 | 3.828 | 189.30 |
| 237 | 0.627 | 0.746 | 2.579 | 122.18 |
| 238 | 0.536 | 0.674 | 3 | 125.18 |
| 239 | 0.300 | 0.576 | 6 | 180.95 |

TABLE III

| Section | Slip-joint fitting length (m) |
|---|---|
| 231-232 | 0.579 |
| 232-233 | 0.682 |
| 233-234 | 0.784 |
| 234-235 | 0.883 |
| 235-236 | 0.919 |
| 236-237 | Flange |
| 237-238 | 0.876 |
| 239 | 0.749 |

As explained previously, the number of side supporting elements may vary according to specific loading considerations. In the embodiment shown in the FIG. 2, a secondary level of guys (215) is attached to the metallic vertical structure (202) between the adjoining region (211) and the smaller end (204) of the lower frustum (203). In this embodiment, each level of side supporting elements has four guys.

The invention claimed is:

1. A structure for supporting electric power transmission lines, comprising:

a metallic vertical structure having (i) a lower tubular frustum shape with a smaller end and a larger end, wherein the smaller end is on the bottom and the larger end is on the top;

(ii) an upper tubular frustum shape with a smaller end and a larger end, wherein the smaller end is on the top and the larger end is on the bottom; and (iii) wherein the larger end of the lower tubular frustum is adjoined to the larger end of the upper tubular frustum;

at least one line supporting member;

at least one side supporting element, wherein the side supporting element is attached in the adjoining region of the lower and upper frustums, and said side supporting element extends between said attachment and an anchoring base; and wherein the adjoining region is below the at least one line supporting member.

2. A structure according to claim 1, wherein the adjoining region is the region where the bending moment of the structure is the highest.

3. A structure according to claim 1, wherein the side supporting element is a guy, a wire, a cable, a strut, a support brace or a combination thereof.

4. A structure according to claim 1, wherein the lower frustum shape comprises at least one tubular frustum section, and the upper frustum shape comprises at least one tubular frustum section.

5. A structure according to claim 4, wherein the connection between the tubular sections are provided by bolted flanges, slip joint, bolted slip joint, welding or combinations thereof.

6. A structure according to claim 5, wherein the tubular sections have an essentially circular cross sections.

7. A structure according to claim 5, wherein the tubular sections have an essentially elliptical or oblong cross sections.

8. A structure according to claim 7, wherein the elliptical or oblong cross section semi-major axis is substantially perpendicular to the orientation of the transmission line.

9. A structure according to claim 8, wherein to the metallic vertical structure is inclined towards a secondary metallic vertical structure, said vertical structure combination resulting in a delta structure configuration.

* * * * *